US007566185B2

(12) United States Patent
Samuelson et al.

(10) Patent No.: US 7,566,185 B2
(45) Date of Patent: Jul. 28, 2009

(54) CONTAINER WITH INTEGRALLY FORMED RECOIL DEVICE

(76) Inventors: Jacob D. Samuelson, 318 E. 1825 North, Centerville, UT (US) 84014; Christopher G. Samuelson, 919 S. 800 East, Centerville, UT (US) 84014

( * ) Notice: Subject to any disclaimer, the term of this patent is extended or adjusted under 35 U.S.C. 154(b) by 0 days.

(21) Appl. No.: 11/623,691

(22) Filed: Jan. 16, 2007

(65) Prior Publication Data

US 2007/0166095 A1 Jul. 19, 2007

Related U.S. Application Data

(60) Provisional application No. 60/759,122, filed on Jan. 13, 2006.

(51) Int. Cl.
*B43K 23/02* (2006.01)

(52) U.S. Cl. ..... 401/131; 401/52

(58) Field of Classification Search ..... 401/52, 401/195, 88, 131, 29, 33, 99, 109
See application file for complete search history.

(56) References Cited

U.S. PATENT DOCUMENTS

| | | | | |
|---|---|---|---|---|
| 1,567,783 | A | 12/1925 | Best | |
| 2,248,338 | A | 7/1941 | Castleman | |
| 2,258,841 | A * | 10/1941 | Biro | 401/194 |
| 2,615,648 | A * | 10/1952 | Carlson | 242/384.7 |
| 2,793,617 | A * | 5/1957 | Palmer | 224/162 |
| 4,486,169 | A | 12/1984 | Lewis | 431/253 |
| 4,898,532 | A | 2/1990 | Bercik | 431/253 |
| 5,026,274 | A | 6/1991 | Jacob | 431/253 |
| 5,352,053 | A * | 10/1994 | Reitze | 401/202 |
| 5,531,349 | A | 7/1996 | Wojcik et al. | 220/339 |
| 6,283,658 | B1 | 9/2001 | Estevez et al. | 401/98 |
| 6,382,481 | B1 | 5/2002 | McIlmoil | 224/162 |
| D464,793 | S | 10/2002 | Anderton | D3/215 |
| D468,092 | S | 1/2003 | Anderton | D3/215 |
| D478,721 | S | 8/2003 | Anderton | |
| 6,607,323 | B2 | 8/2003 | Breidenbach et al. | 401/6 |
| 6,641,390 | B2 | 11/2003 | Genuise | 431/253 |
| D502,311 | S | 3/2005 | Ellis | D3/215 |

FOREIGN PATENT DOCUMENTS

KR 2004027596 A * 4/2004

* cited by examiner

*Primary Examiner*—Huyen Le
(74) *Attorney, Agent, or Firm*—Kunzler & McKenzie

(57) ABSTRACT

A container is disclosed that includes an elongated, substantially hollow body having at least one opening, and a recoil mechanism integrally formed in the body and comprising a lanyard configured to extend from and recoil into the body. The container also includes a plunger slideably coupled with an interior surface of the body and configured to one of extend the item outward from an opening in the body, or, retract the item inward into the body. The container may include a flip-top cap integrally formed with the body, and an advance mechanism that causes the plunger to extend or retract in response to the direction of a rotating force.

19 Claims, 5 Drawing Sheets

CONTAINER WITH INTEGRALLY FORMED RECOIL DEVICE

CROSS-REFERENCES TO RELATED APPLICATIONS

This application is a continuation-in-part of and claims priority to U.S. Provisional Patent Application No. 60/759,122 entitled "CONTAINER WITH INTEGRALLY FORMED RECOIL DEVICE" and filed on Jan. 13, 2006 for Jacob D. Samuelson, which is incorporated herein by reference.

BACKGROUND OF THE INVENTION

1. Field of the Invention

This invention relates to lip balm containers and more particularly relates to a lip balm dispenser having an integrally formed recoil device for securely fastening the lip balm dispenser to an object.

2. Description of the Related Art

For at least 70 years people have been applying various forms of lip balm to their lips in order to relieve chapped or dry lips, and cold sores. Lip balm is generally formed of petroleum jelly, menthol, scented oils, and various other ingredients. Some lip balms also contain vitamins or other beneficial agents such as aspirin. Many lip balms also contain some form of a sunscreen to protect the lips.

Lip balm comes in many different form factors including a tub for dipping a finger and then spreading on the lips, or a stick form (similar to lipstick) which is applied directly to the lips. These containers are often small in nature and therefore prone to being lost. Furthermore, lip balm containers are often stored in a bag or purse and become difficult to locate among the various other articles in the bag.

Another problem with current lip balm containers is the dexterity required to open, dispense, and close the lip balm container. Due to the size of the container, often times a person must use both hands to remove the cap and dispense lip balm. If gloves are being worn this task becomes nearly impossible. A large number of outdoor winter enthusiasts use lip balm because cold weather leads to chapped lips. Outdoor winter enthusiasts almost always wear some type of glove or mitten, and unfortunately, are unable to dispense and apply lip balm without first removing the gloves or mittens. Typically a skier must first remove his or her gloves, dig through the pocket or bag that contains the lip balm, apply the lip balm, return the lip balm to the pocket or bag, and replace the gloves. This is an uncomfortable but necessary procedure when using lip balm of the prior art.

Many have attempted to solve portions of the above described problem. For example, one apparatus provides a carrying case that attaches to a hook on a ski jacket. The carrying case is similar in structure to a pouch. However, one must still remove his or her gloves in order to remove the lip balm from the pouch, and dispense lip balm.

Another solution is to attach a neck lanyard to the lip balm. One problem with this solution is that the lanyard must be of sufficient length so that the lip balm can be applied to the lips when the lanyard is around a person's neck. However, the resulting length of the lanyard requires that one tuck the lanyard beneath clothing to prevent the lip balm from swinging and bouncing excessively. Again, gloves or mittens must be removed in order to retrieve and apply the lip balm.

From the foregoing discussion, it should be apparent that a need exists for a container having an integrally formed recoil device that prevents loss and a lip balm dispensing device that capable of one-handed operation, or operation when a person is wearing a glove or mitten.

SUMMARY OF THE INVENTION

The present invention has been developed in response to the present state of the art, and in particular, in response to the problems and needs in the art that have not yet been fully solved by currently available lip balm containers. Accordingly, the present invention has been developed to provide an apparatus that overcomes many or all of the above-discussed shortcomings in the art.

The container is provided with an elongated, substantially hollow body having at least one opening, a recoil mechanism integrally formed in the body and comprising a lanyard configured to extend from and recoil into the body, and a plunger slideably coupled with an interior surface of the body and configured to one of extend the item outward from an opening in the body, or, retract the item inward into the body.

The container may include a flip-top cap integrally formed with the body. The cap may include a ridge extending outward from the cap to enable one-finger operation. The cap is configured to cover the opening. The container also includes an advance mechanism formed on an exterior surface of the body. The advance mechanism is mechanically coupled with the plunger such that a rotating force causes the plunger to one of extend or retract in response to the direction of the rotating force.

In one embodiment, the container includes a threaded shaft coupled with the body. The shaft extends along a longitudinal axis of the body from a partition towards the opening. The threaded shaft is configured to engage a threaded opening in the plunger, rotate with the advance mechanism, and slide the plunger along the longitudinal axis in response to the rotating force.

In a further embodiment, the body includes a first chamber, a second chamber, and a partition disposed between the first and second chambers. The container may also include a hook coupled to a first end of the lanyard and configured to securely couple the container with an object. Examples of the object include articles of clothing, luggage, outerwear, sporting equipment, and vehicles. The item may include lip balm, cosmetic products, food products, coins, keys, pocket knives, and flashlights. In one embodiment, the recoil mechanism includes a spiral spring having first and second ends, where the first end is securely fastened with a shaft and the second end is coupled with the lanyard.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
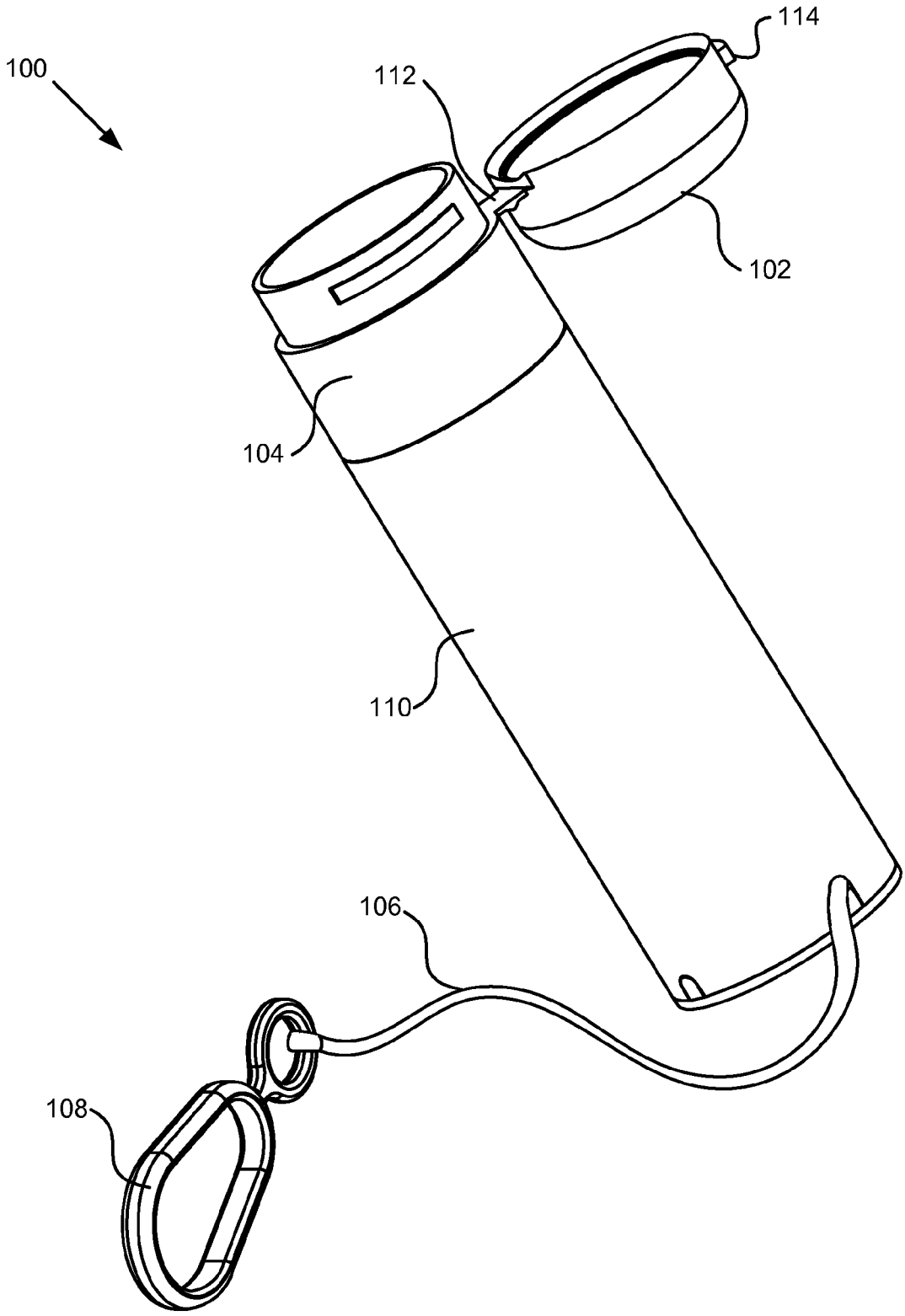
FIG. 1 is a schematic block diagram illustrating one embodiment of a container having an integrally formed recoil device in accordance with the present invention.

FIG. 1 is a schematic block diagram illustrating one embodiment of a container 100 having an integrally formed recoil device in accordance with the present invention. In one embodiment, the container 100 is configured with a flip-top lid 102, an advance mechanism 104, a lanyard 106, and an attachment mechanism 108. The container 100 may be cylindrical as depicted in FIG. 1. Alternatively, the container 100 may have an elongated tubular shape having a cross-sectional area in the form of a square, rectangle, oval, etc.

The flip-top lid 102 may be integrally formed with a body 110, and coupled with the body 110 by way of a hinge 112. In a further embodiment, the lid 102 is detachable from the body 110. In a further embodiment, the lid 102 may include a ridge 114 for engaging the finger of a user in order to enable "flip-top" like functionality without requiring two fingers to pull off the cap 102.

The advance mechanism 104 is configured to vertically lift an item to expose or discharge the item from the body 110. Examples of items that may be exposed or discharged from the body include, but are not limited to, lip balm, lipstick, other cosmetic products, hard candy such as suckers, soft candy, coins, keys, etc. The body may be formed substantially of a lightweight rigid material such as, a polymer-based material. Examples of polymer based materials suitable for use with the present invention include, but are not limited to, polyethylene, nylon, or the like.

In one embodiment, the lanyard 106 comprises a cable or cord configured to extend and subsequently retract into the body 110. As used herein, the term "lanyard" refers to a flexible line of rope, wire, wire rope, or strap that is attached to any small object for the purpose of securing the object. The recoil mechanism will be discussed below with reference to FIGS. 3 and 4. As depicted, the lanyard 106 extends outward from the side of the body. Coupled with one end of the lanyard 106 is the attachment mechanism 108. The attachment mechanism 108 may comprise a hook, plastic or otherwise, configured to secure the container 100 to an article of clothing, a bag, a belt, a belt loop, a pocket, a purse, or the like. Alternatively, the attachment mechanism 108 may comprise a key ring. The lanyard 106 may be formed of nylon or an alternative durable material and is of a length sufficient to enable a user to move the container 100 to a desirable location such as adjacent the user's mouth.

Figure 2:
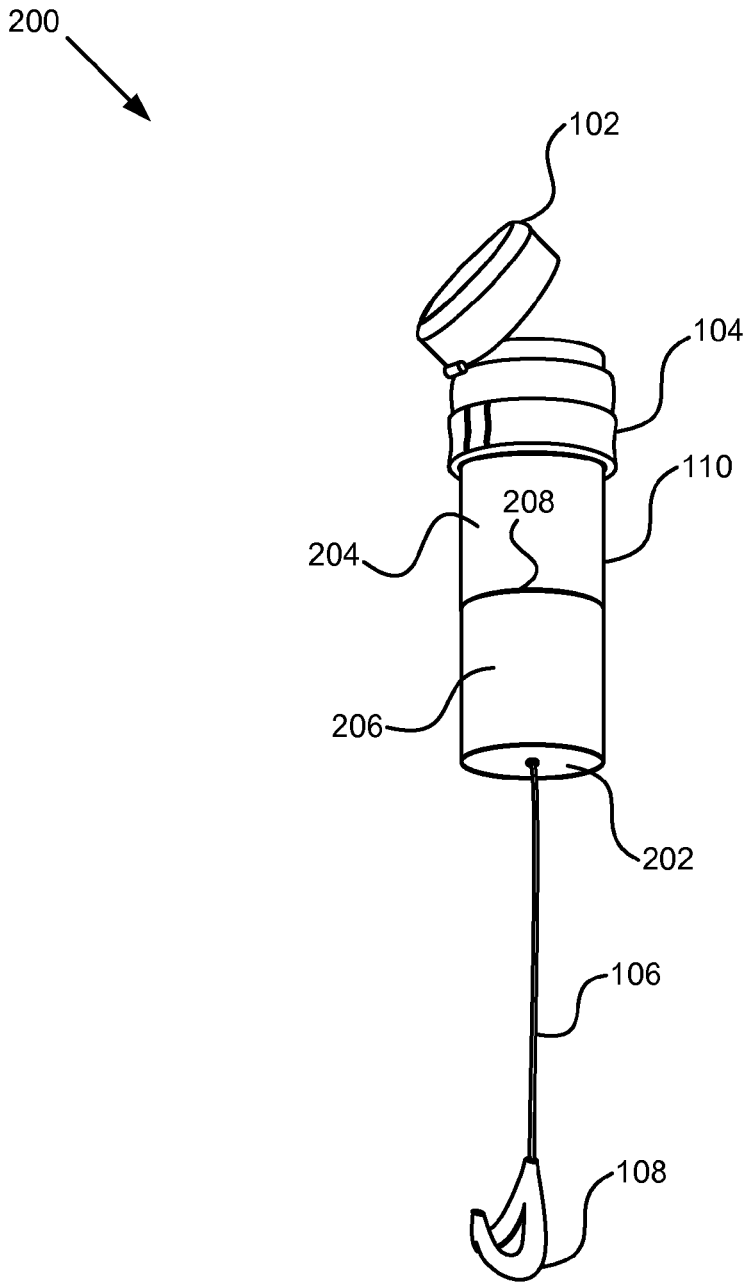
FIG. 2 is a side and bottom perspective view diagram illustrating one embodiment of a container having a lanyard extending outward from a bottom of the container in accordance with the present invention.

FIG. 2 is a side and bottom perspective view diagram illustrating one embodiment of a container 200 having a lanyard 106 extending outward from a bottom 202 of the container 200. In one embodiment, the body 110 may comprise a first chamber 204 for housing the item, and a second chamber 206 for housing the recoil mechanism. The body 110 may have an externally visual separation of the chamber 204, 206 as illustrated by the line 208, or there may be no externally visual evidence that the body comprises first and second chambers 204, 206. Line 208, in one embodiment indicates the position of a partition inside the body 110 disposed between the first and second chambers 204, 206.

Figure 3:
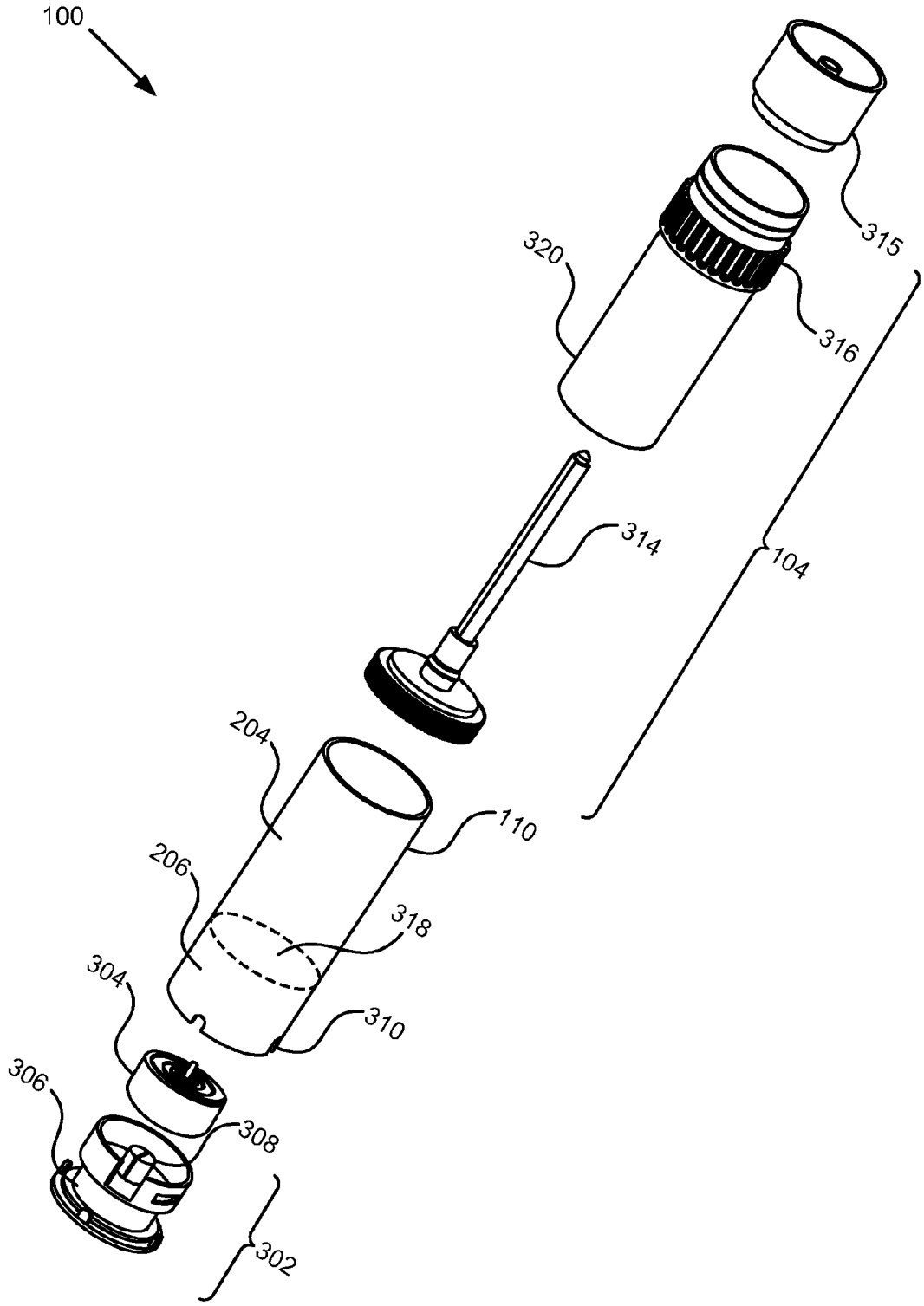
FIG. 3 is an exploded view diagram illustrating one embodiment of the container in accordance with the present invention.

FIG. 3 is an exploded view diagram illustrating one embodiment of the container 100 in accordance with the present invention. In one embodiment, the container comprises a recoil mechanism 302 located in the second or lower chamber 206 of the body 110. The recoil mechanism 302 may comprise a spiral spring 304, and a reel 306. An interior end of the spiral spring 304 may be fixedly connected with a peg 308, and the exterior end of the spiral spring 304 may be fixedly connected with the reel 306. At least one end of the peg 308 is fixedly coupled with the body 110.

In one embodiment, the lanyard 106 comprises a first end connected with the reel 306 and a second end connected with the attachment mechanism 108. The body 110 further comprises an opening 310 through which the lanyard 106 may pass. The opening 310 may include a metal grommet to prevent the lanyard from wearing through the body 110 as the lanyard 106 passes through the opening 310. As the lanyard 106 is extracted from the body 110, the reel 306 turns and subsequently tensions the spiral spring 304. The tensioned spiral spring 304 serves to recoil the lanyard 106 once the extracting force is removed from the lanyard 106.

The advance mechanism, in one embodiment, may comprise a threaded rod 314, and a plunger 315. In the depicted embodiment, the advance mechanism also comprises a collar 316 configured to engage the finger or fingers of a user in order to extend or discharge the plunger 315. The collar 316, as depicted, may be disposed next to the lid 102, or alternatively may be disposed above the spiral spring 304. The plunger 315, as depicted, is configured to contain an item such as lip balm, lip stick, etc., as described above.

The plunger 315 is configured to support the item, and engage the threaded rod 314. As a user turns the collar 316, which may be integrally formed with the body, the threaded rod 314 also turns. Subsequently, the plunger 315 climbs the threaded rod 314 and extends or discharges the item 315. The threaded rod 314, in one embodiment, is fixedly coupled with the body 110. The threaded rod may be coupled with a partition 318 integrally formed with the body 110 and configured to separate the first chamber 204 from the second chamber 206.

The body 110, in one embodiment, may be configured as a sleeve to house the advance mechanism 104. As depicted, the advance mechanism may comprise an inner cylinder 320 configured to engage the body 110. This inner cylinder 320 configuration allows a person to, with one hand, hold the body 110 while rotating the advance mechanism 104 and extend or retract the item.

Figure 4:
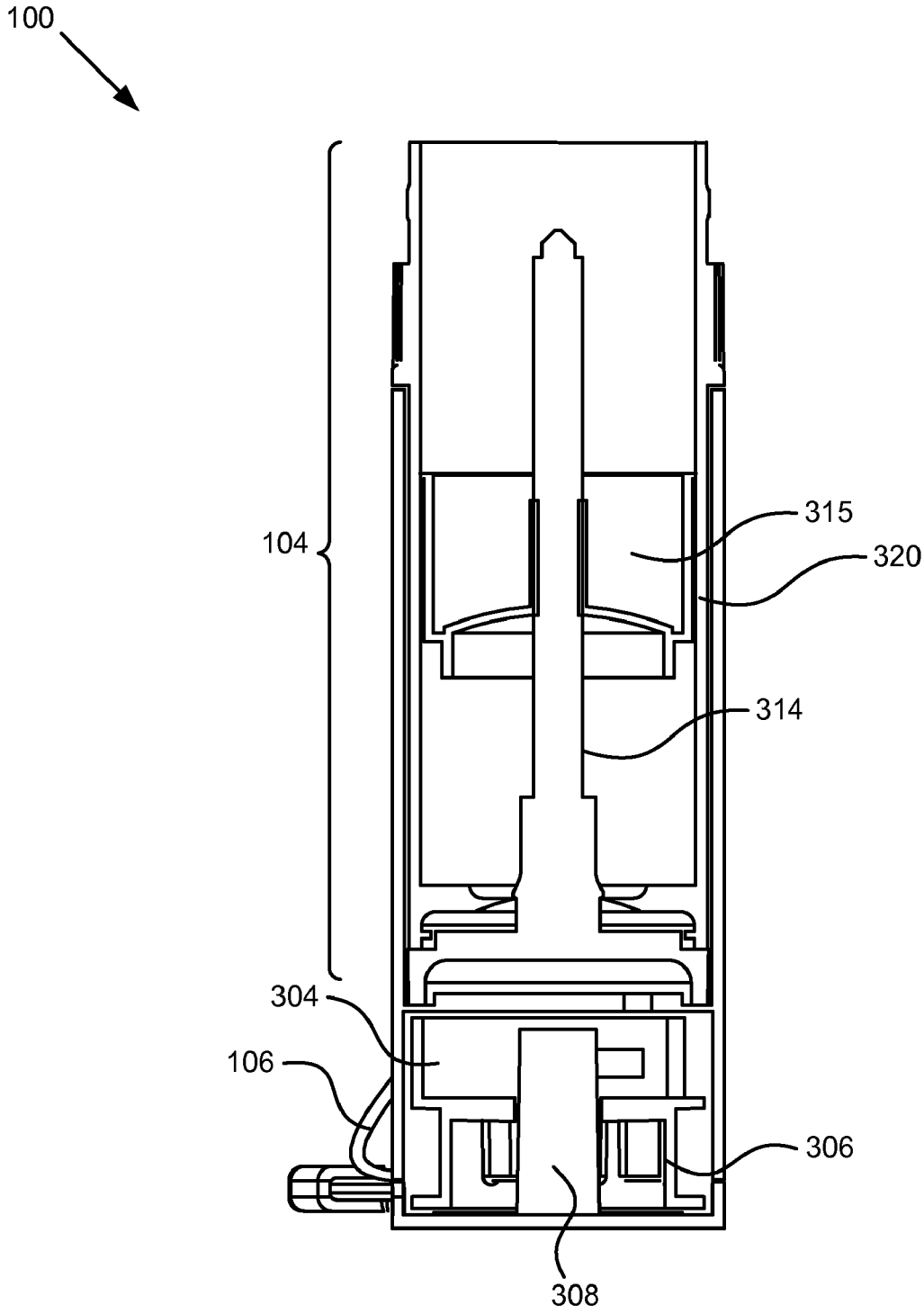
FIG. 4 is a cross-sectional view diagram illustrating the assembled internal components of the container in accordance with the present invention.

FIG. 4 is a cross-sectional view diagram illustrating the assembled internal components of the container 100 in accordance with the present invention. In one embodiment, the separate elements may be arranged as depicted, with the spiral spring 304 mounted to a top surface of the reel 306. Alternatively, the spiral spring 304 may be mounted to a bottom surface of the reel 306. The threaded rod 314 may be configured to pass into the second chamber and serve as the fixed peg for fixing the interior end of the spiral spring 304 and providing a point about which the reel 306 may rotate. Alternatively, this function may be performed by the peg 308 as described above.

Figure 5:
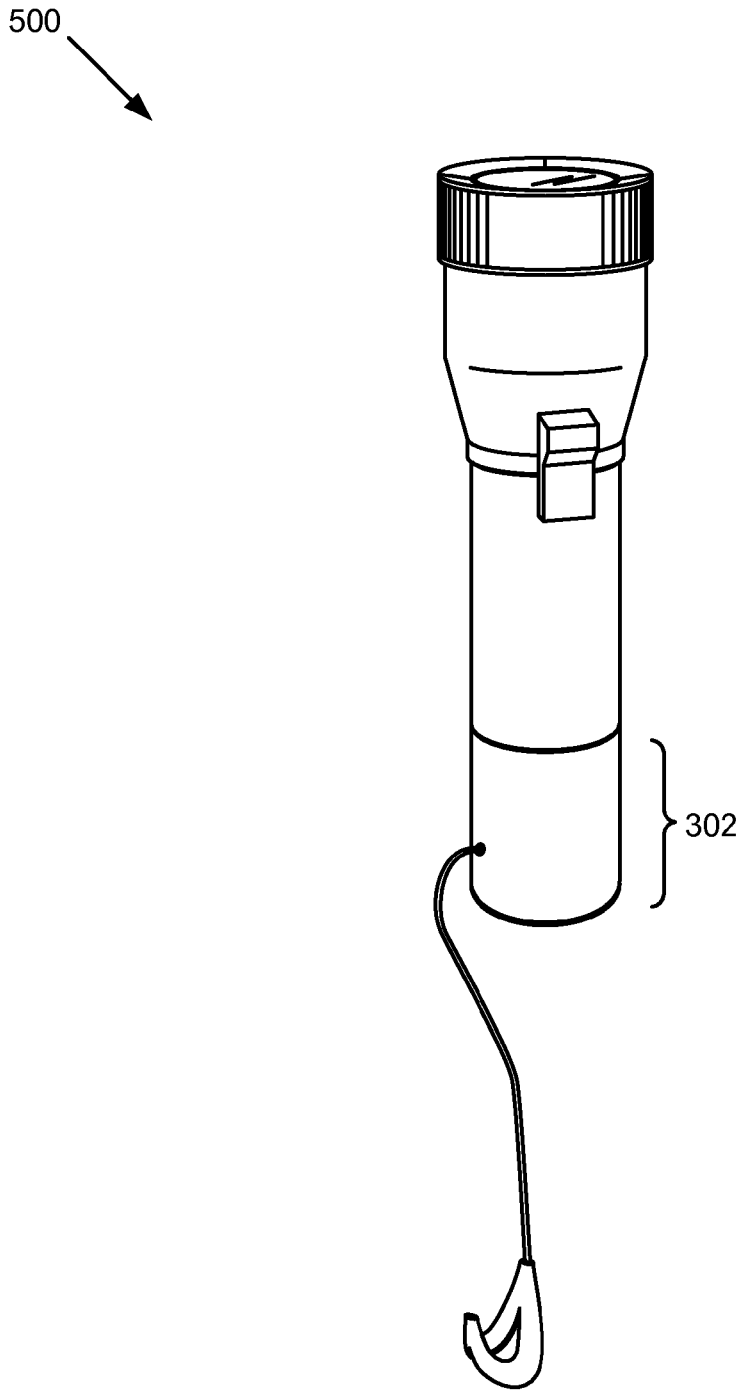
FIG. 5 is a schematic block diagram illustrating an alternative embodiment of a container in accordance with the present invention.

FIG. 5 is a schematic block diagram illustrating an alternative embodiment of a container 500 in accordance with the present invention. In one embodiment, the container 500 is configured in the shape of a flashlight. The recoil mechanism 302 may be integrally formed into the container 500 and thereby provide a flashlight with a built-in recoil mechanism 500. The container 500 is illustrated here as a flashlight by way of example. However, one skilled in the art will recognize that the recoil mechanism 302 may be integrated into many objects. These objects may include, but are not limited to, LED lights, pepper spray containers, weapons such as tazers, cigarette lighters, portable flash memory drives, portable media players, etc.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container comprising:

an elongated, substantially hollow body having at least one opening;

a recoil mechanism integrally formed in the body and comprising a lanyard configured to extend from and recoil into the body;

the body configured to contain an item;

a plunger slideably coupled with an interior surface of the body and configured to extend the item outward from an opening in the body and retract the item inward into the body; and a hook coupled to a first end of the lanyard and configured to securely couple the container with an object.

2. The container of claim 1, further comprising a flip-top cap integrally formed with the body, the cap comprising a ridge extending outward from the cap to enable one-finger operation, the cap configured to cover the at least one opening.

3. The container of claim 1, further comprising an advance mechanism formed on an exterior surface of the body and mechanically coupled with the plunger such that a rotating force causes the plunger to one of extend or retract in response to the direction of the rotating force.

4. The container of claim 3, further comprising a threaded shaft coupled with the body and extending along a longitudinal axis of the body from a partition towards the opening, the threaded shaft configured to engage a threaded opening in the plunger, rotate with the advance mechanism, and slide the plunger along the longitudinal axis in response to the rotating force.

5. The container of claim 1, wherein the body further comprises a first chamber, a second chamber, and a partition disposed between the first and second chambers.

6. The container of claim 1, wherein the object is selected from the group consisting of article of clothing, luggage, outerwear, sporting equipment, and vehicle.

7. The container of claim 1, wherein the item is selected from a group consisting of lip balm, cosmetic products, food products, coins, keys, pocket knives, and flashlights.

8. The container of claim 1, wherein the recoil mechanism further comprises a spiral spring having first and second ends, the first end securely fastened with a shaft and the second end coupled with the lanyard.

9. A container comprising:

an elongated, substantially hollow body having at least one opening;

a recoil mechanism integrally formed in the body and comprising a lanyard configured to extend from and recoil into the body;

the body configured to contain an item;

a plunger slideably coupled with an interior surface of the body and configured to extend the item outward from an opening in the body and retract the item inward into the body; and a flip-top cap integrally formed with the body, the cap comprising a ridge extending outward from the cap to enable one-finger operation, the cap configured to cover the at least one opening.

10. The container of claim 9, further comprising an advance mechanism formed on an exterior surface of the body and mechanically coupled with the plunger such that a rotating force causes the plunger to one of extend or retract in response to the direction of the rotating force.

11. The container of claim 10, further comprising a threaded shaft coupled with the body and extending along a longitudinal axis of the body from a partition towards the opening, the threaded shaft configured to engage a threaded opening in the plunger, rotate with the advance mechanism, and slide the plunger along the longitudinal axis in response to the rotating force.

12. The container of claim 9, wherein the body further comprises a first chamber, a second chamber, and a partition disposed between the first and second chambers.

13. The container of claim 9, further comprising a hook coupled to a first end of the lanyard and configured to securely couple the container with an object.

14. A container comprising:

an elongated, substantially hollow body having at least one opening;

a recoil mechanism integrally formed in the body and comprising a lanyard configured to extend from and recoil into the body;

the body configured to contain an item;

a plunger slideably coupled with an interior surface of the body and configured to extend the item outward from an opening in the body and retract the item inward into the body;

a flip-top cap integrally formed with the body, the cap comprising a ridge extending outward from the cap to enable one-finger operation, the cap configured to cover the at least one opening;

an advance mechanism formed on an exterior surface of the body and mechanically coupled with the plunger such that a rotating force causes the plunger to one of extend or retract in response to the direction of the rotating force a hook coupled to a first end of the lanyard and configured to securely couple the container with an object.

15. The container of claim 14, further comprising a threaded shaft coupled with the body and extending along a longitudinal axis of the body from a partition towards the opening, the threaded shaft configured to engage a threaded opening in the plunger, rotate with the advance mechanism, and slide the plunger along the longitudinal axis in response to the rotating force.

16. The container of claim 14, wherein the body further comprises a first chamber, a second chamber, and a partition disposed between the first and second chambers.

17. The container of claim 14, wherein the object is selected from the group consisting of article of clothing, luggage, outerwear, sporting equipment, and vehicle.

18. The container of claim 14, wherein the item is selected from a group consisting of lip balm, cosmetic products, food products, coins, keys, pocket knives, and flashlights.

19. The container of claim 14, wherein the recoil mechanism further comprises a spiral spring having first and second ends, the first end securely fastened with a shaft and the second end coupled with the lanyard.

* * * * *